United States Patent [19]

Esteves

[11] 4,249,151

[45] Feb. 3, 1981

[54] APPARATUS FOR VARIABLY ADJUSTING A MAGNETIC LEVEL WITH A TRANSLATING SPRING FORCE

[75] Inventor: Mabel R. Esteves, Rio Piedras, P.R.

[73] Assignee: Sylvania Circuit Breaker Corporation, Canovanas, P.R.

[21] Appl. No.: 60,692

[22] Filed: Jul. 25, 1979

[51] Int. Cl.[3] ..... H01H 71/74

[52] U.S. Cl. ..... 335/176; 335/42

[58] Field of Search ..... 335/176, 42, 8, 9, 10

[56] References Cited

U.S. PATENT DOCUMENTS

| | | | |
|---|---|---|---|
| 3,391,361 | 7/1968 | Jencks et al. | 335/176 |
| 3,484,728 | 12/1969 | Shaffer | 335/176 |
| 3,845,432 | 10/1974 | Heberlein, Jr. et al. | 335/176 |
| 4,114,123 | 9/1978 | Grenier | 335/176 |

*Primary Examiner*—Harold Broome

*Attorney, Agent, or Firm*—Fred Fisher

[57] ABSTRACT

A three pole circuit breaker includes, for each pole, an electrical conductor, a magnet in close proximity to the conductor so as to generate a magnetic field when excessive current flows therethrough, an armature adapted to be attracted to the magnet when the magnetic field is generated therein, and an extension spring adapted to restrain the armature from attraction by the magnet. A common translating crossbar is coupled to the extension springs for simultaneously varying forces on the three extension springs, so as to vary a magnetic level for the circuit breakers.

The circuit breaker further includes a housing, a button rotatable within the housing and adapted to be rotated from without the housing, and a cam affixed to the button within the housing. The cam is coupled to the crossbar so that rotation of the button causes translating movement of the crossbar.

Movement of an armature toward its respective magnet causes particular movement of a respective trip bar leg which actuates a circuit breaker mechanism.

1 Claim, 4 Drawing Figures

APPARATUS FOR VARIABLY ADJUSTING A MAGNETIC LEVEL WITH A TRANSLATING SPRING FORCE

CROSS-REFERENCE TO RELATED APPLICATION

A co-pending patent application, Ser. No. 60,693, filed July 25, 1979, entitled "Magnetic Trip Adjustment Based on Spring Load Variation", by Victor Vazquez, assigned to the common assignee of this application, and filed concurrently herewith, concerns related subject matter.

BACKGROUND OF THE INVENTION

This invention relates to apparatus for variably adjusting the magnetic level of a system with a translating spring force, and, in particular, to multipole circuit breakers wherein the magnetic levels of the poles are simultaneously adjusted by varying forces of extension springs associated with respective armatures. Accordingly, it is a general object of this invention to provide new and improved apparatus and circuit breakers of such character.

Generally, in the past, the magnetic trip level of circuit breakers were not variable or adjustable. Thus, since circuit breakers were produced to "standard" conditions, separate selected circuit breakers were required for selected magnetic levels.

Specifically, it is believed that at least one manufacturer offers for sale circuit breakers having adjustable magnetic trip levels by virtue of adjustable gaps. Some such device uses a comparatively large variable gap of 600 to 800 mils.

SUMMARY OF THE INVENTION

An object of this invention is to provide for new and improved combinations utilizing an extension spring for applying a variable force for restraining an armature from attraction by a magnet.

Another object of this invention is to provide for new and improved circuit breakers in which the magnetic trip level can be adjusted and varied.

Still another object of this invention is to provide for new and improved multipole circuit breakers in which the magnetic trip level currents for all poles can be simultaneously varied and adjusted.

Yet another object of this invention is to provide for new and improved circuit breakers, having adjustable magnetic trip levels, with smaller gaps—in the order of 100 mils—than corresponding circuit breakers of the prior art.

In accordance with one embodiment of this invention, a combination includes an armature adapted to be attracted by a magnet, an extension spring which restrains the armature from attraction by the magnet, and means for varying a force on the spring. In accordance with another embodiment, three armatures are each adapted to be attracted to respective ones of three magnets. Three extension springs are each adapted to restrain a respective one of the armatures from attraction by its respective magnet. The forces on the three extension springs are simultaneously varied. In accordance with yet another embodiment, a magnet is in close proximity to an electrical conductor so that when excessive current flows therein, a magnetic field is generated in the magnet. An extension spring restrains an armature from attraction by the magnet when the magnetic field is generated therein. A force on the extension spring is varied so as to vary a magnetic level. In accordance with certain features, a circuit breaker mechanism is adapted to be actuated by a particular movement of a trip bar leg so that movement of the armature toward the magnet causes particular movement of the trip bar leg, thereby actuating the circuit breaker mechanism.

In accordance with yet another embodiment of the invention, a three pole circuit breaker includes, in combination, three electrical conductors, three magnets, three armatures, and three extension springs. Each extension spring is adapted to restrain a respective one of the armatures from attraction by its respective magnet when a magnetic field is generated therein due to excessive current flowing through a respective conductor in close proximity to the respective magnet. The forces on the three extension springs are simultaneously varied so as to vary a magnetic level of the circuit breaker. In accordance with certain features of the invention, a circuit breaker combination is adapted to be actuated by a particular movement of any one of three trip bars legs. Each trip bar leg is so associated with a respective one of the armatures that movement of the respective armature toward the respective magnet causes particular movement of the associated trip bar leg, thereby actuating the circuit breaker mechanism. In accordance with other features of the invention, the three pole circuit breaker further includes a housing. The means for simultaneously varying forces on the extension springs includes a common translating crossbar coupled to the three extension springs. A cam is affixed to a button within the housing, the button being rotatable from without the housing. The cam is coupled to the translating crossbar so that rotational movement of the button causes translating movement of the crossbar.

BRIEF DESCRIPTION OF THE DRAWINGS

Other objects, advantages and features of the invention, together with its construction and mode of operation, will become more apparent from the following description, when read in conjunction with the accompanying drawing, in which.

DESCRIPTION OF A PREFERRED EMBODIMENT

Figure 1:
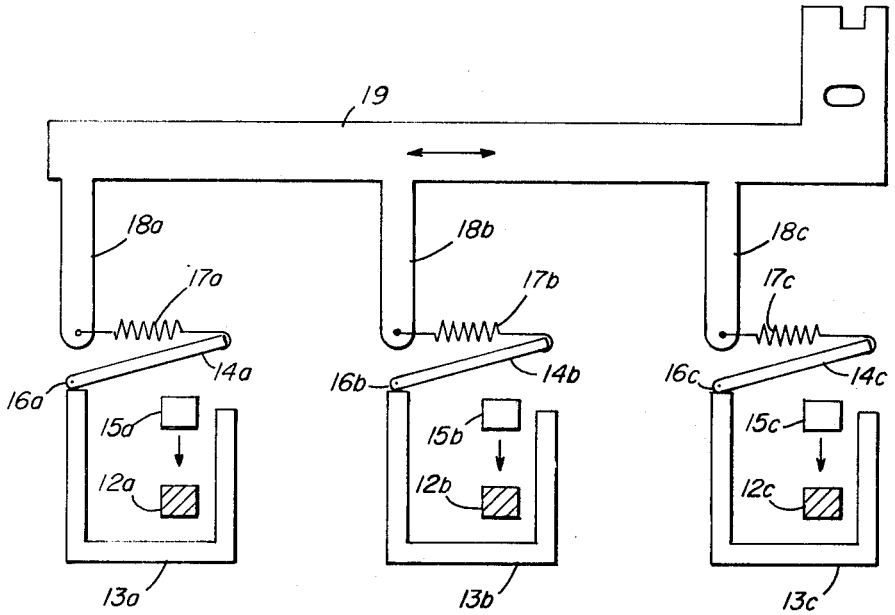
FIG. 1 is a simplified representation of one embodiment of this invention.
Figure 2:
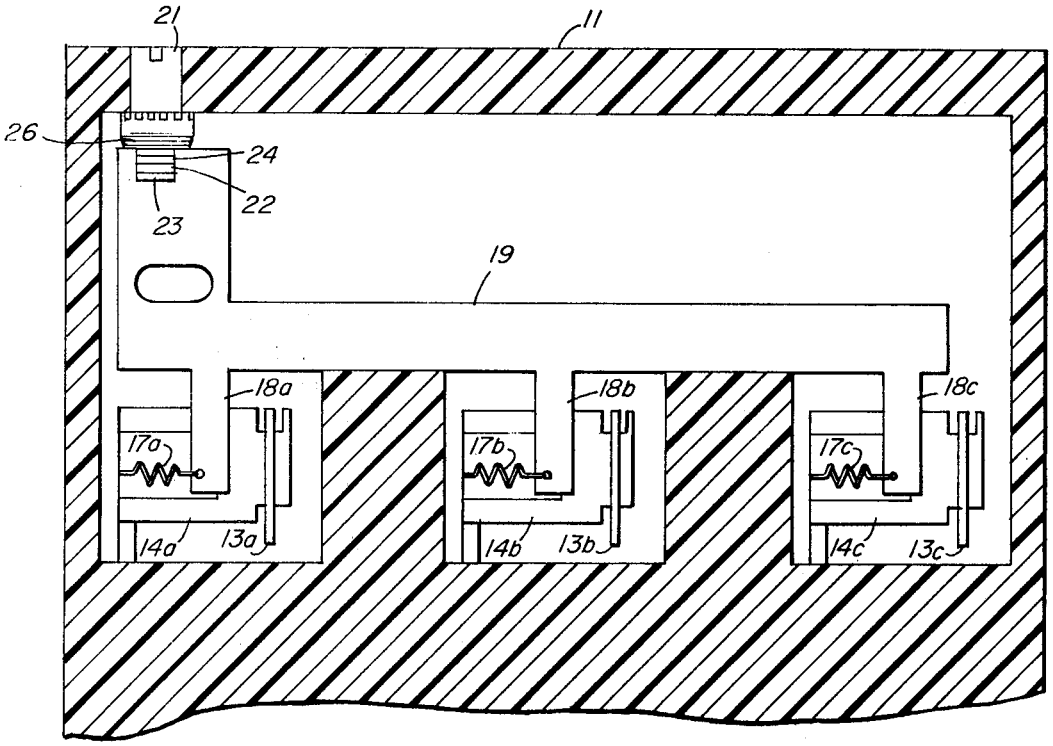
FIG. 2 is a fragmentary, sectional view of one embodiment of the invention.

Referring to the drawing, a housing 11 (FIG. 2) for a three pole circuit breaker has three conductors 12*a*, 12*b*, 12*c* therewithin, such conductors being shown perpendicular to the plane of the drawing of FIG. 1.

Each conductor 12*a*, 12*b*, 12*c* has a respective pole piece 13*a*, 13*b*, 13*c* associated therewith. (For convenience, and usage, the term "magnet" is used throughout the specification in lieu of "pole piece").

A respective armature 14*a*, 14*b*, 14*c* is associated with each respective magnet 13*a*, 13*b*, 13*c*, being pivotable about a respective pivot point 16*a*, 16*b*, 16*c*.

Each armature 14*a*, 14*b*, 14*c* has a trip bar leg 15*a*, 15*b*, 15*c*, respectively, associated therewith so that movement of the respective armature toward the respective magnet causes particular movement of the associated trip bar leg.

Figure 3:
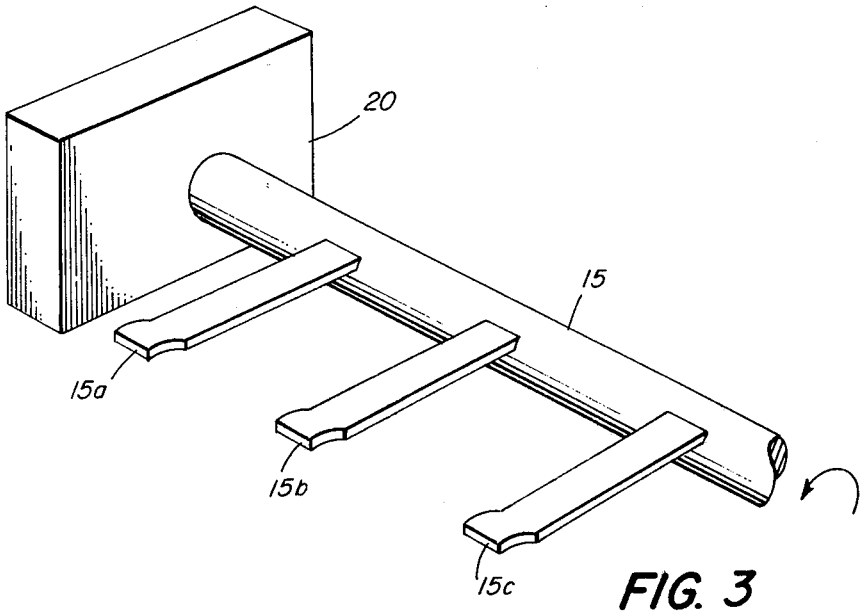
FIG. 3 is a diagrammatic view of a plurality of trip bar legs of a trip bar, in conjunction with a circuit breaker mechanism, useful in one embodiment of the invention.

A circuit breaker mechanism 20 (FIG. 3) is adapted to be actuated by a particular movement of any of the trip bar legs 15*a*, 15*b*, 15*c*, such legs being formed on a common trip bar 15.

Figure 4:
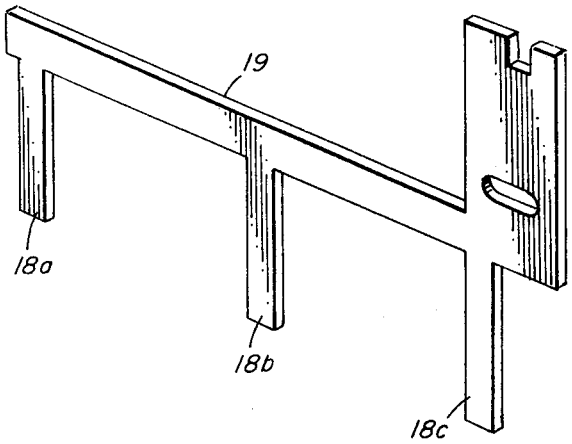
FIG. 4 is a perspective view of a common crossbar, useful with one embodiment of the invention.

Each armature 14*a*, 14*b*, 14*c* (FIG. 1) is coupled by a respective extension spring 17*a*, 17*b*, 17*c* to legs 18*c*, 18*b*, 18*c* of a common crossbar 19 (FIG. 4).

An adjustment button 21 (FIG. 2), fixed within the cover of the circuit breaker housing 11, has a link 22 coupled thereto, which, in turn, is coupled to the crossbar 19.

The button 21 has a grap arm 23, a button fixer 24, and a push button spring 26 associated therewith.

In operation, a system is provided for linearly varying the magnetic tripping current level over a range of multiple amounts of continuous over current rating in a molded case circuit breaker. In one embodiment, the range varied from five to twelve times the continuous current rating.

The foregoing is achieved by simultaneously varying the spring force on the hinged armatures 14*a*, 14*b*, 14*c* of each of the three poles of the circuit breaker.

This is achieved by the use of the translating crossbar 19 which is simultaneously linked through three extension springs 17*a*, 17*b*, 17*c* to the three respective hinged armatures 14*a*, 14*b*, 14*c*. The translation of the crossbar 19 varies the extension of each spring 17*a*, 17*b*, 17*c* simultaneously by the same distance, therefore varying the spring forces which effectively varies the magnetic current levels.

The translation of the crossbar 19 is effected by manually rotating the button 21 which, in turn, rotates the link 22 to the crossbar 19. Rotation of the link 22 causes translation of the crossbar 19.

The gap between an armature and its respective magnet is approximately 100 mils. Hence, with this invention, less space is required than known corresponding devices of others. Further, with this invention, the magnetic level can be varied in a linear form.

In accordance with the invention, a circuit-breaker was constructed having a variable range of magnetic level adjusted current from 5 to 12 times its normal rating. Thus, with a 100 ampere nominally rated breaker, current having a magnitude of 500 to 1200 amperes passing therethrough present tripping levels at 5 to 12 times the nominal rating. Depending upon the variable adjustment, a particular magnitude of current can be set for tripping of the magnetic level.

Various modifications will suggest themselves to those skilled in the art without departing from the spirit and scope of this invention.

What is claimed is:

1. In a combination, in a three pole circuit breaker, including a housing;

three electrical conductors, one for each pole;

three magnets, each magnet in close proximity to a respective one of said conductors so as to generate a magnetic field therein when excessive current flows through said respective conductor;

three armatures, each armature adapted to be attracted by a respective one of said magnets when a magnetic field is generated in said respective magnet;

three extension springs, each spring adapted to restrain a respective one of said armatures from attraction by its respective magnet; and means for simultaneously varying forces on said three extension springs so as to vary a magnetic level for said circuit breaker, the improvement wherein said means for simultaneously varying forces on said extension springs comprises a common translating crossbar coupled to said extension springs;

a button rotatable within said housing and adapted to be rotated from without said housing; and a cam affixed to said button within said housing;

said cam being coupled to said translating crossbar so that rotational movement of said button causes translating movement of said crossbar.

* * * * *